US005529704A

United States Patent [19]

Guerci et al.

[11] Patent Number: 5,529,704

[45] Date of Patent: Jun. 25, 1996

[54] LEATHER FAT-LIQUORING AGENTS

[75] Inventors: Alberto Guerci; Donato Dipinto, both of Turin; Hanspeter Gathoffer, Caselette, all of Italy

[73] Assignee: Hoechst Aktiengesellschaft, Germany

[21] Appl. No.: 321,972

[22] Filed: Oct. 12, 1994

Related U.S. Application Data

[63] Continuation-in-part of Ser. No. 45,927, Apr. 12, 1993, abandoned.

[30] Foreign Application Priority Data

Apr. 10, 1992 [DE] Germany ..... 42 12 054.3

[51] Int. Cl.[6] ..... C14C 9/02

[52] U.S. Cl. ..... 252/857; 8/94.21; 8/94.22; 8/94.23; 554/88

[58] Field of Search ..... 8/94.21, 94.22, 8/94.23; 252/8.87, 182.11, 182.12; 554/88

[56] References Cited

U.S. PATENT DOCUMENTS

| | | | |
|---|---|---|---|
| 4,741,738 | 5/1988 | Friese et al. | 8/94.19 R |
| 4,800,045 | 1/1989 | Friese et al. | 554/88 |
| 4,903,362 | 2/1990 | Friese et al. | 8/94.23 |

FOREIGN PATENT DOCUMENTS

| | | |
|---|---|---|
| 1297887 | 3/1992 | Canada . |
| 214628 | 10/1984 | Germany . |
| 0178557 | 4/1986 | Germany . |
| 0247490 | 12/1987 | Germany . |

*Primary Examiner*—Ponnathapura Achutamurthy
*Attorney, Agent, or Firm*—Connolly & Hutz

[57] ABSTRACT

The present invention relates to a process for the preparation of a fat-liquoring compositions based on oxysulfited oils of animal and/or vegetable origin, the fatty substances employed containing a) 70–99% by weight of fatty substances of animal and/or vegetable origin and b) 30–1% by weight of compounds of the formula I $$R^1+\underset{\underset{R^2}{|}}{C}=CH-CH=\underset{\underset{R^3}{|}}{C}\Big)_m+C_nH_{2n}+COOR^4 \qquad (I)$$

which differ from the compounds of component a) and in which $R^1$, $R^2$ and $R^3$ independently of one another are branched or straight-chain, optionally substituted $C_1$–$C_{24}$-alkyl radicals, $R^4$ is hydrogen or a straight-chain or branched, optionally substituted $C_1$–$C_8$-alkyl radical, m and n integers which are greater than zero and the process has the steps of:

oxidation of compositions based on fatty substances containing the components a) and b) at a temperature above 40° C. and reacting the resulting oxidized composition with a 10 to 40% strength by weight aqueous solution of a base and subsequent sulfitation by addition of a 5 to 50% strength by weight solution of a sulfiting agent with simultaneous or subsequent heating.

19 Claims, No Drawings

LEATHER FAT-LIQUORING AGENTS

RELATED APPLICATIONS

This application is a continuation-in-part of Ser. No. 08/045,927 filed Apr. 12, 1993, which is now abandoned.

Leather obtains some of its most important properties for use as a result of fat-liquoring. The following are particularly strongly affected: elasticity, hardness, toughness, extensibility, absorptivity or water-repellency and air permeability.

Conventional fat-liquoring agents and auxiliaries for leather fat-liquoring are structured on the basis of animal oils, such as fish oil, and/or vegetable oils, such as sunflower oil. However, on their own the fats can only be applied with difficulty and have no depth of penetration into the corium, and they must be converted into water-emulsifiable fatty substances by chemical modification. These actual fat-liquoring agents, also called fat-liquors, consist of an emulsified solid and the corresponding emulsifier. A customary possibility of obtaining fat-liquors is the oxidation and subsequent sulfitation of the fats.

Certain demands are made on the process and on the leather fat-liquoring agent obtained by it, in particular on the part of the user.

In respect of the process, the oxidation of the oils employed should be as complete as possible, it being intended that the duration of the oxidation should take up as small a time as possible. In order to shorten the oxidation times, it was customary until now to employ metal catalysts, such as cobalt naphthenate, zinc sulfate, aluminum sulfate or sodium oxalate.

In spite of the use of catalysts, the oxidation often lasted several days.

The leather fat-liquoring agents obtained by the process of oxysulfitation often showed disadvantageous properties, such as too high a viscosity, in particular at low temperatures, an unpleasant fish-like odor and too low a chromium stability.

To decrease the odor annoyance, inorganic peroxides and also hydrogen peroxide (DD-A-21 46 28) have been customarily employed.

In spite of the abovementioned improvement measures, the desire still existed for fat-liquoring compositions which are distinguished by improved properties in use, in particular in the area of leather-working.

U.S. Pat. No. 4,800,045 relates to sulfited fats prepared by oxidation of fats with oxygen-containing gas mixtures and simultaneous or subsequent sulfitation using alkali and/or ammonium hydrogen sulfites, wherein the fats used are mixtures containing (A) fats having iodine numbers below about 100, and (B) fatty acid esters having iodine numbers from 60 to 100 and containing from 12 to 24 carbon atoms in the liner or branched, natural and/or synthetic fatty acid residue and from 1 to 5 carbon atoms in the monofunctional alcohol residue;

the ratio of weight of A to B being from 9:1 to 1:4.

Difficulty sulfitable fats having iodine numbers below 100, and preferably of from 7 to 95, are preferably mixed with fatty acid esters having iodine numbers of from 60 to 100 in a ratio by weight of fat to fatty acid ester of from 4:1 to 2:3.

It was an object of the present invention to make available a process for the preparation of fat-liquoring compositions based on oxysulfited oils of animal and/or vegetable origin, which process requires shorter oxidation times in comparison with known oxysulfitation processes and does not necessarily dictate the use of metal catalysts and odor-reducing substances, such as peroxides.

It was a further object of the invention to make available compositions based on oxysulfited oils of animal and/or vegetable origin, which, compared with the known fat-liquoring compositions, have improved properties in use, such as low viscosity, in particular at lower temperatures, low intrinsic odor, better penetration and improved stability against oxidizing compounds.

Surprisingly, it has been shown that the desired improvements are achieved by the use of conjugated unsaturated carboxylic acids and/or esters.

The invention relates to a process for the preparation of fat-liquoring compositions comprising the measures:

oxidation of compositions based on fatty substances containing:

a) 70–99% by weight of fatty substances of animal and/or vegetable origin having a iodine number of at least 110, preferably from about 110 to 200 and b) 30–1% by weight of compounds of the formula I $$R^1\text{-}\underset{\underset{R^2}{|}}{C}=CH-CH=\underset{\underset{R^3}{\|}}{C}\text{-}_m\text{-}C_nH_{2n}\text{-}COOR^4$$

which differ from the compounds of component a) and in which $R^1$, $R^2$ and $R^3$ independently of one another are branched or straight-chain, optionally substituted $C_1$–$C_{24}$-alkyl radicals, $R^4$ is hydrogen or a straight-chain or branched, optionally substituted $C_1$–$C_8$-alkyl radical, m is an integer which is greater than zero and n is an integer which is greater than zero, at a temperature above 40° C., preferably in the range from 40° to 90° C., particularly preferably 50° to 80° C., if necessary reaction of the oxidized fatty substances with a 10 to 40% strength by weight aqueous alkali metal hydroxide solution and subsequent sulfitation by addition of a 5 to 50% strength by weight, preferably 20 to 40% strength by weight, solution of a sulfitation agent with simultaneous or subsequent heating.

The invention also relates to fat-liquoring compositions obtainable by a process which comprises the above-mentioned measures.

The process for the preparation of the fat-liquoring compositions according to the invention is first explained and the fat-liquoring compositions according to the invention are subsequently described.

Starting substances used for the preparation of the fat-liquoring compositions according to the invention are compositions based on fatty substances of animal origin and/or vegetable origin having iodine numbers of at least 110, preferably from about 110 to 200 (component a). Examples of fatty substances of animal origin are fish oil, fish liver oil and its transformation products, neat's-foot oil, sperm oil, egg oils and tallow fat. Fish oil and neat's-foot oil are preferably used.

Apart from the fatty substances of animal origin, fatty substances of vegetable origin can also be employed as starting substances.

Examples of fatty substances of vegetable origin are castor oil, rape oil, olive oil, soybean oil, sunflower oil, palm oil, groundnut oil, cotton oil and linseed oil. Rape oil and sunflower oil are preferably used.

Said fatty substances of animal and vegetable origin can be employed in the process according to the invention as individual substances or mixtures.

If only fatty substances of animal or vegetable origin are employed as starting substances for the preparation of the fat-liquoring compositions according to the invention, their amount is 70–99% by weight, relative to the total weight of the mixture.

If fatty substances of animal and vegetable origin are employed, the starting substances have a composition in the ratio between 30 to 99.9% by weight of fatty substances of animal origin and 70 to 0.1% by weight of fatty substances of vegetable origin, relative to the total weight of fatty substances employed. A preferred composition consists of approximately equal parts of fish oil, neat's-foot oil and rape oil.

Apart from said fatty substances (component a), as further starting substances compounds of the formula I $$R^1+\underset{\underset{R^2}{\|}}{C}=CH-CH=\underset{\underset{R^3}{|}}{C}\Big)_m+C_nH_{2n}+COOR^4$$

are employed as component b), which compounds differ from the compounds of component a) and in which $R^1$, $R^2$ and $R^3$ independently of one another are straight-chain or branched, optionally substituted $C_1$–$C_{24}$-alkyl radicals, preferably straight-chain, optionally substituted $C_{18}$–$C_{20}$ -alkyl radicals, $R^4$ is hydrogen or a straight-chain or branched, optionally substituted $C_1$–$C_8$-alkyl radical, m is an integer which is greater than zero, preferably 1 to 5, particularly preferably 1, and n is an integer which is greater than zero, preferably 1 to 20.

Suitable substituents are, for example, OH, OR, $NH_2$, $NHR^1$, $NHR^1{}_2$ or halogen.

Preferably, compounds of the formula II $$R^1+\underset{\underset{R^2}{|}}{C}=CH-CH=\underset{\underset{R^3}{|}}{C}\Big)_m+CH_2\Big)_n COOR^4$$

are employed as component b), which compounds differ from the compounds of component a) and in which $R^1$, $R^2$, $R^3$, $R^4$, m and n have the abovementioned meaning.

Other suitable starting substances (component c) are compounds of the formula III $$R^5—COO—R^4$$

which differ from the compounds of components a) and b) and in which $R^5$ is a straight-chain or branched, optionally OH-substituted $C_8$–$C_{24}$-alkyl, $C_8$–$C_{24}$-alkenyl or $C_8$–$C_{24}$-alkadienyl radical and $R^4$ has the abovementioned meaning. These compounds of the formula III are optionally present in an amount of up to 30% by weight, relative to the total weight of the mixture.

Lauric acid, palmitic acid, stearic acid, margaric acid, 10-methylstearic acid, oleic acid, linoleic acid, conjugated linoleic acid, linolenic acid and their esters are particularly preferably used as components b) and c). The compounds of the formulae I, II and optionally III can be employed as individual substances or in the form of mixtures of two or more individual substances.

Additives can be added to the compositions according to the invention to control the final composition, for example alkanolamines, such as diethanolamine for an optimum pH, hydrocarbons, such as liquid paraffin, for the desired viscosity, low molecular weight mineral oil or synthetic oils, based on chlorinated or otherwise modified paraffin derivatives and plasticizers, such as glycerol.

These additives are preferably added after finishing of the fat-liquoring compositions.

The starting substances situated in a suitable reactor are subjected to an oxidation at a temperature above 40° C., preferably in the range from 40° to 90° C., particularly preferably 50° to 80° C. The oxidation is preferably carried out by introduction of a moderate stream of air into the composition at a rate of 200 to 400 l/h.

The end point of the oxidation is indicated by the adequate sulfitability of the oxidized fatty substance. For this purpose, a sample is taken from the reaction mixture during the oxidation and sulfited as described below. An adequate sulfitability is understood as meaning that during the introduction of this oxysulfited sample, preferably 10% by weight in water, a fine emulsion is formed which is stable over a period of at least one day at room temperature and has a chromium stability of at least 5 hours. It has been shown that the end point of the oxidation and thus these properties are in general achieved 10 to 30 hours earlier than in the known processes.

Subsequent to the oxidation and before sulfitation, reaction of the oxidized fatty substances with a 10 to 40% strength by weight, preferably 20 to 30% strength by weight, aqueous solution of a strong base, such as alkali metal hydroxide, can be carried out.

For the purposes of sulfitation, the oxidized starting substances are treated with the solution of a sulfiting agent. Aqueous solutions of sodium pyrosulfite, sodium hydrogensulfite or sulfur trioxide are preferably used as sulfiting agents. The concentration of the aqueous solutions is in the range from 5 to 50% by weight, preferably 20 to 40% by weight.

During or preferably after the addition of the sulfiting agent, the reaction mixture is heated. Customarily, the reaction mixture is heated to the boiling point. The reaction mixture is heated until a sample taken satisfies the desired requirements with respect to appearance, emulsifiability in water and electrolyte resistance, in particular chromium stability. The sample should be clear when taken, i.e. transparent and without discoloration. With respect to emulsifiability in water, the sample should form a stable, finely dispersed emulsion. These requirements are assessed by simple observation. The chromium stability of the sample should be shown over a period of more than 5 hours, preferably at least 10 hours.

The chromium stability of the oxysulfited fatty substances is tested in the following manner. 5 ml of the oxysulfited sample are dispersed in 90 ml of distilled water in a calibrated 100 ml measuring cylinder. 5 ml of an aqueous chromium sulfate solution are added to this dispersion and vigorous shaking. The chromium sulfate solution consists of a solution of 56 g of basic chromium sulfate of the formula $Cr(OH)SO_4 \times nH_2O$ containing 25% by weight of $Cr_2O_3$. The time until phase separation occurs is the measure of the chromium stability.

An additional treatment of the oxidized starting substances by washing and/or neutralization is not necessary in the process according to the invention, so the entire reaction sequence can take place in the same reactor.

Advantages of the process according to the invention which may be mentioned are:

shorter oxidation times in comparison with conventional processes no use of metal catalysts necessary no use of peroxides necessary.

Advantages of the fat-liquoring compositions according to the invention which may be mentioned are:

nearly odorless products low viscosities, in some cases still pourable at 0° C.

high chromium stability application properties similar to the products based on pure fish oil.

The fat-liquoring compositions according to the invention are outstandingly suitable as readily emulsifiable, electrolyte-resistant fat-liquoring agents for the fat-liquoring of sophisticated exotic fur goods, clothing, suede, furniture, glove and fine upper leather and are preferably employed for preliminary fat-liquoring and fat-liquoring after washing. The fat-liquored leathers have a good pliability and fullness with a close-lying firm grain.

The fat-liquoring compositions according to the invention are preferably suitable as leather fat-liquoring agents. It has been shown that the products penetrate leather well and impart a soft, light, but full feel.

EXAMPLES

Example 1

323 g of fish oil, 337 g neat's-foot oil, 300 g of rape oil and 40 g of PREFAC® acid 8968 (manufacturer: Unichema, Chemie GmbH, DE) are oxidized with atmospheric oxygen (rate: 340 l/h) at 70° C. in a 2 l reactor. After 40 hours, the mixture has a viscosity of 3 minutes 30 seconds, measured with a "Ford beaker" No. 2 at 27° C. After the oxidation is complete, 25.6 g of a 30% strength by weight aqueous NaOH solution are added with stirring at a temperature of 40° C. The solution is stirred for 30 minutes at the temperature which is established by the heat of reaction. 280 g of a 35% strength by weight $Na_2S_2O_5$ solution are then added successively in equal parts. After the addition of the first half of the $Na_2S_2O_5$ solution, the mixture is stirred for 15 minutes at the temperature which is established by the heat of reaction. After completion of the addition of the second half, the temperature is increased to the boiling point. The viscosity of the final product is 10 minutes and 30 seconds, measured with a "Ford cup" No. 2 at 27° C. The chromium stability is given for a period of more than 5 hours.

Composition of PREFAC® acid 8968

23% $C_{18}$-carboxylic acid (monounsaturated),

9% $C_{18}$-carboxylic acid (diunsaturated),

50% $C_{18}$-carboxylic acid (conjugated unsaturated),

1% $C_{18}$-carboxylic acid (triunsaturated),

1% $C_{20}$-carboxylic acid

Example 2

323 g of fish oil, 337 g of neat's-foot oil and 300 g of rape oil and 40 g of PREFAC® acid 8961 are reacted analogously to Example 1. After 60 hours, the mixture has a viscosity of 6 minutes 10 seconds, measured with a "Ford cup" No. 2 at 27° C. Sulfitation is carried out analogously to Example 1. The viscosity of the final product is 18 minutes 25 seconds, measured with a "Ford cup" No. 2 at 27° C. The chromium stability is given over a period of more than 5 hours.

Composition of PREFAC® acid 8961

3% $C_{18}$-carboxylic acid,

1% $C_{18}$-carboxylic acid,

25% $C_{18}$-carboxylic acid (monounsaturated),

67% $C_{18}$-carboxylic acid (diunsaturated),

1% $C_{18}$-carboxylic acid (triunsaturated)

We claim:

1. A process for the preparation of a fat-liquoring composition comprising the following steps:

oxidizing, at a temperature above 40° C., an oxidizable composition containing:

a) 70–99% by weight of a fatty oil of animal origin or a fatty oil of vegetable origin or a combination of said oils and b) 30–1% by weight of an acid or monoester of formula I having an iodine number greater than 100,

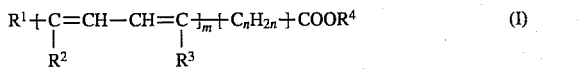

(I)

in which $R^1$, $R^2$, and $R^3$, independently of one another, are branched or straight-chain, optionally substituted $C_1$–$C_{24}$-alkyl radicals;

$R^4$ is hydrogen or a straight-chain or branched alkyl radical which is unsubstituted or substituted by OH, $OR^1$, $NH_2$, $NHR^1$, $NHR^1{}_2$ or halogen;

m is a number which is greater than zero and n is an integer which is greater than zero;

reaction the resulting oxidized composition with a 10 to 40% strength by weight aqueous solution of a base and subsequently sulfitating the resulting oxidized composition with a 5 to 50% strength by weight solution of a sulfitation agent and with heating which is simultaneous with or subsequent to the combination of the oxidized composition with the sulfitation agent.

2. The process as claimed in claim 1, wherein said oxidizable composition further contains c) up to 30% by weight of an acid or monoester of formula III

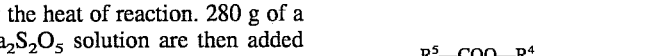

(III)

the acid or monoester of formula III being different from said acid or monoester of formula I, and, wherein, in formula III $R^5$ is straight-chain or branched, optionally OH-substituted $C_9$–$C_{24}$-alkyl, $C_9$–$C_{24}$-alkenyl or $C_9$–$C_{24}$-alkadienyl radical and $R^4$ is as defined in claim 1.

3. The process as claimed in claim 1, wherein said component a) contains:

30–99.9% by weight of a fatty oil of animal origin, and

70–0.01% by weight of a fatty oil of vegetable origin, relative to the total weight of said component a).

4. The process as claimed in claim 1, wherein said component a) contains approximately equal parts by weight of fish oil, neat's foot oil, and rape oil.

5. The process as claimed in claim 1, wherein said acid or monoester of formula I has the formula II

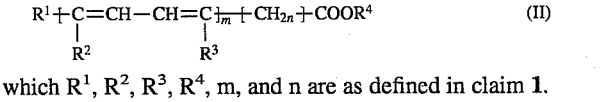

(II)

in which $R^1$, $R^2$, $R^3$, $R^4$, m, and n are as defined in claim 1.

6. The process as claimed in claim 1, wherein, in formula I, m is a number from 1 to 5, and n is an integer from 1 to 20.

7. The process as claimed in claim 1, wherein, in formula I, $R^1$, $R^2$, and $R^3$, independently of one another, are a straight-chain, optionally substituted $C_{16}$–$C_{20}$-alkyl radical.

8. The process as claimed in claim 1, wherein said oxidizing step is carried out by contacting said oxidizable composition with a stream of air at a temperature in the range from 40° to 90° C.

9. The process as claimed in claim 1, wherein said sulfitation agent comprises an aqueous solution containing $Na_2S_2O_5$, sodium hydrogensulfite, or sulfur trioxide.

10. The process as claimed in claim 8, wherein said temperature is in the range from 50° to 80° C.

11. The process as claimed in claim 6, wherein m is one.

12. The process as claimed in claim 1, wherein, in formula I, $R^4$ is hydrogen.

13. The process as claimed in claim 5, wherein, in formula II, $R^4$ is hydrogen.

14. A fat-liquoring composition prepared by the process of claim 1.

15. A method for fat-liquoring leather comprising the step of treating the leather with the fat-liquoring composition of claim 14.

16. The process as claimed in claim 1, wherein said acid or monoester of formula I, has an iodine number greater than 100 up to 200.

17. The process as claimed in claim 16, wherein said compounds of formula (I) have an iodine number from about 110 to 200.

18. The process as claimed in claim 1, wherein said 10 to 40% strength by weight aqueous solution of the base is an aqueous alkali metal hydroxide solution.

19. The process as claimed in claim 18, wherein said alkali metal hydroxide is NaOH in an amount from 20 to 30% strength by weight.

* * * * *